US007946388B2

(12) United States Patent
Kobayashi et al.

(10) Patent No.: US 7,946,388 B2
(45) Date of Patent: May 24, 2011

(54) OIL PAN APPARATUS

(75) Inventors: Hideo Kobayashi, Mishima (JP); Katuhiko Arisawa, Gotenba (JP); Yoshio Yamashita, Susono (JP); Kunihiko Hayashi, Ashigarakami-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 1019 days.

(21) Appl. No.: 11/792,671

(22) PCT Filed: Jan. 16, 2006

(86) PCT No.: PCT/JP2006/300905

§ 371 (c)(1), (2), (4) Date: Jun. 8, 2007

(87) PCT Pub. No.: WO2006/077996

PCT Pub. Date: Jul. 27, 2006

(65) Prior Publication Data

US 2008/0083586 A1 Apr. 10, 2008

(30) Foreign Application Priority Data

Jan. 18, 2005 (JP) ..... 2005-009822

(51) Int. Cl.
*F16N 29/00* (2006.01)
*F16N 31/00* (2006.01)
*F01M 11/10* (2006.01)

(52) U.S. Cl. ..... 184/6.4; 184/7.4; 184/1.5; 184/104.2

(58) Field of Classification Search ..... 184/1.5, 184/6.4, 6.5, 7.4, 106
See application file for complete search history.

(56) References Cited

U.S. PATENT DOCUMENTS

| | | | | |
|---|---|---|---|---|
| 4,134,380 | A | 1/1979 | Niwa et al. | |
| 4,730,704 | A * | 3/1988 | Ohno | 184/6.4 |
| 5,103,782 | A * | 4/1992 | Matsui | 123/195 C |
| 5,465,692 | A * | 11/1995 | Uraki et al. | 123/195 C |
| 6,568,509 | B1 * | 5/2003 | Sugiura | 184/106 |
| 6,845,743 | B1 * | 1/2005 | Bishop | 123/195 C |
| 2004/0084250 | A1 * | 5/2004 | Morii et al. | 184/106 |
| 2006/0041362 | A1 * | 2/2006 | Chida et al. | 701/51 |
| 2009/0020367 | A1 * | 1/2009 | Kawashima | 184/106 |

FOREIGN PATENT DOCUMENTS

| | | |
|---|---|---|
| DE | 102 45 357 A1 | 4/2004 |
| FR | 2 816 354 A1 | 5/2002 |
| JP | 60-128917 | 7/1985 |
| JP | A 2001-152825 | 6/2001 |
| JP | A 2003-222012 | 8/2003 |
| JP | A 2003-278519 | 10/2003 |

* cited by examiner

*Primary Examiner* — Michael R Mansen
*Assistant Examiner* — Robert T Reese
(74) *Attorney, Agent, or Firm* — Oliff & Berridge, PLC

(57) ABSTRACT

An oil temperature sensor is externally mounted on a side plate of an oil pan cover that constitutes an external cover for an oil pan apparatus. The oil temperature sensor can output a signal in accordance with the oil temperature prevailing near a thermostat valve apparatus in a second chamber. If the second chamber oil temperature rises immediately after start-up of an engine, a CPU judges that an open valve failure has occurred, that is, the thermostat valve apparatus is stuck open. If the oil temperature of the second chamber is not raised when an adequate amount of time has elapsed after the end of a warm-up operation, the CPU judges that a closed valve failure has occurred, that is, the thermostat valve apparatus is stuck closed.

6 Claims, 11 Drawing Sheets

(a)

(b)

OIL PAN APPARATUS

TECHNICAL FIELD

The present invention relates to an oil pan apparatus for storing oil for lubricating a lubrication target mechanism (e.g., engine block or automatic transmission mechanism).

BACKGROUND ART

In general, an oil pan apparatus of the above type is fastened to the underside of a lubrication target mechanism, and is configured so as to store oil in the internal space of an oil pan cover, which constitutes an outer cover for the oil pan apparatus. An oil-pan-attached machine (e.g., engine or automatic transmission device), which is equipped with the oil pan apparatus, is configured so that an oil pump takes in the oil from an oil intake port of an oil strainer, which is positioned in the oil pan apparatus, and supplies the oil to lubrication target members (e.g., gear, camshaft, cylinder, and piston) in the lubrication target mechanism. Further, the oil-pan-attached machine is configured so that the oil, which is supplied to the lubrication target members as described above, lubricates the lubrication target members, absorbs heat, which is generated due, for instance, to friction, and flows back to the oil pan apparatus from the lubrication target mechanism by gravitation.

A two-tank oil pan structure, which is disclosed, for instance, by Patent Reference 1, is widely known as a conventional oil pan structure.

[Patent Reference 1] Japanese Patent JP-A No. 278519/2003

In an oil pan apparatus having the two-tank oil pan structure which is disclosed by Patent Reference 1 (hereinafter referred to as the conventional technology), a partition plate is positioned within the internal space of an outer board that corresponds to the oil pan cover. The partition plate divides the internal space into two sections: a first chamber in which the oil strainer is located, and a second chamber which is adjacent to the first chamber.

The partition plate is provided with communication paths that permit the interchange of oil between the first and second chambers. Each communication path is provided with an open/close valve for permitting the passage of oil in the communication path in accordance with the oil temperature. In other words, the open/close valve is configured so as to control the interchange of oil through the communication paths between the first and second chambers in accordance with the temperature of the oil stored in the oil pan apparatus. More specifically, the open/close valve closes the communication paths when the oil temperature is lower than a predetermined temperature, and opens the communication paths when the oil temperature is not lower than the predetermined temperature, thereby permitting the passage of oil in the communication paths.

When the above conventional technology is used, the open/close valve closes at engine startup or in other situations where the oil temperature is low. Then, only the oil in the first chamber is supplied to the lubrication target mechanism and circulated between the lubrication target mechanism and oil pan apparatus. This increases the speed of oil temperature rise in the first chamber so that a warm-up operation may terminate early. Further, the open/close valve opens when the oil temperature is high. The oil stored in the oil pan apparatus is then entirely supplied to the lubrication target mechanism and circulated between the lubrication target mechanism and oil pan apparatus. This ensures that lubrication and cooling operations are properly performed for the lubrication target mechanism, and prevents the oil durability from deteriorating.

DISCLOSURE OF THE INVENTION

When the open/close valve becomes defective, the oil-pan-attached machine is not properly lubricated. If, for instance, the valve is stuck open (this failure is hereinafter referred to as "open valve failure"), the open/close valve remains open immediately after engine startup during which the oil temperature is low (and the oil in the oil pan apparatus can be entirely circulated between the lubrication target mechanism and oil pan apparatus). Therefore, the oil temperature in the first chamber does not readily rise. As a result, the warm-up operation does not terminate early. If, on the other hand, the valve is stuck closed (this failure is hereinafter referred to as a closed valve failure), the open/close valve remains closed (and only the oil in the first chamber can be circulated between the lubrication target mechanism and oil pan apparatus) even when the oil temperature in the first chamber becomes high after completion of the warm-up operation. Therefore, the oil temperature in the first chamber rises excessively, thereby incurring early oil deterioration or other problems.

As described earlier, the open/close valve is provided for the partition plate that is positioned in the internal space of the outer board. That is, the open/close valve is positioned within the oil pan apparatus. Therefore, the conventional technology cannot detect a defect in the open/close valve from the outside of the oil pan apparatus.

The present invention has been made to solve the above problem. It is an object of the present invention to provide an oil pan apparatus having a two-tank oil pan structure, which uses a simple structure to detect a defect in a valve mechanism that is positioned in a communication path for communication between a first chamber and a second chamber to control the interchange of oil in the communication path in accordance with the oil temperature in the oil pan apparatus. To achieve the above object, the oil pan apparatus according to the present invention is configured as described below.

(1) The oil pan apparatus includes an oil pan cover, which has an internal space for storing lubricating oil for a lubrication target mechanism, and an oil pan separator, which is positioned in the internal space so as to form a first chamber and a second chamber within the internal space, the second chamber being adjacent to the first chamber. The oil pan separator is provided with an oil communication path, which permits the interchange of oil between the first and second chambers. The oil communication path is provided with a valve mechanism, which controls the interchange of oil in the oil communication path between the first and second chambers in accordance with the operation (warm-up status, warm-up time, etc.) of the lubrication target mechanism.

The present invention is characterized by the fact that the oil pan apparatus includes an oil temperature sensor, which outputs a signal in accordance with the oil temperature in the first chamber and/or second chamber, and a judgment section, which judges from an output generated by the oil temperature sensor whether any abnormality exists in the valve mechanism.

As the valve mechanism, a solenoid valve mechanism, a hydraulically-operated valve mechanism, a pneumatic valve mechanism, a thermostat valve mechanism, a bimetal mechanism, or the like may be used.

In the configuration according to the present invention, which is described above, the valve mechanism controls the interchange of oil in the oil communication path between the first and second chambers in accordance with the operation of the lubrication target mechanism. The status of the interchange of oil in the oil communication path between the first and second chambers, which occurs in accordance with the operation of the lubrication target mechanism, may vary depending on whether an abnormality exists in the valve mechanism. Thus, oil temperature changes in the first chamber and/or second chamber may also vary depending on whether an abnormality exists in the valve mechanism. Therefore, the judgment section can judge from an output generated by the oil temperature sensor, which is based on the oil temperature in the first chamber and/or second chamber, whether an abnormality exists in the valve mechanism.

(2) The oil pan apparatus is characterized by the fact that it has the same configuration as described under (1) above. It is also characterized by the fact that an oil strainer is located at a bottom of the first chamber, and that the first chamber is open toward the lubrication target mechanism. The oil strainer constitutes an oil intake port from which an oil pump takes in oil to supply oil to the lubrication target mechanism.

In the configuration according to the present invention, which is described above, the oil pump runs during lubrication target mechanism operation so that the oil at the bottom of the first chamber is taken in from the oil strainer and supplied to the lubrication target mechanism. The oil supplied to the lubrication target mechanism lubricates the lubrication target mechanism and then flows back to the first chamber due to the configuration described under (2).

Further, as is the case with the configuration described under (1), the valve mechanism controls the interchange of oil in the oil communication path. Therefore, the oil in the second chamber may flow into the first chamber and be taken in by the oil strainer depending on the oil interchange control operation that the valve mechanism performs in accordance with the operation of the lubrication target mechanism. Furthermore, the oil flow from the first chamber to the second chamber may also vary with the oil interchange control operation that is performed by the valve mechanism.

As such being the case, the oil temperature change in the first chamber and/or second chamber may vary depending on whether an abnormality exists in the valve mechanism. Therefore, the judgment section can judge from an oil temperature sensor output, which is based on the oil temperature in the first chamber and/or second chamber, whether an abnormality exists in the valve mechanism.

(3) The oil pan apparatus is characterized by the fact that it includes the same oil pan cover and oil pan separator as described under (2) above. The oil pan apparatus is also characterized by the fact that it includes an oil temperature sensor, which is positioned in the second chamber to generate a signal in accordance with the oil temperature in the second chamber, and a judgment section, which judges from the output of the oil temperature sensor whether any abnormality exists in the valve mechanism.

In the configuration described above, the oil temperature sensor, which is used to check for an abnormality in the valve mechanism, may be mounted on the oil pan cover, which constitutes an outer cover of the oil pan apparatus, while the valve mechanism is positioned inside the oil pan apparatus. Thus, the valve mechanism can be checked for an abnormality while an extremely simple apparatus configuration is employed.

(4) Another feature of the present invention is that the following configuration is employed in addition to the configuration described under (3) above. The oil pan separator is open toward the lubrication target mechanism and provided with a concave section that forms the first chamber. A gap for forming a space that constitutes the second chamber is provided between a bottom plate of the oil pan separator and a bottom plate of the oil pan cover, which forms the bottom surface of the second chamber. A side plate for constituting the concave section together with the bottom plate of the oil pan separator is located above and connected to the bottom plate of the oil pan separator. A side plate of the oil pan cover that encloses the side plate of the oil pan separator is located above and connected to the bottom plate of the oil pan cover. A gap for forming a space that constitutes the second chamber is provided between the side plate of the oil pan separator and the side plate of the oil pan cover. The oil temperature sensor is mounted on the side plate or bottom plate of the oil pan cover.

In the configuration described above, the side plate and bottom plate of the oil pan separator on which the valve mechanism is mounted are positioned inside of and a predetermined distance away from the side plate and bottom plate of the oil pan cover, which constitutes the outer cover of the oil pan apparatus. It means that, in the configuration described above, the valve mechanism is positioned inside of and a predetermined distance away from the outer surface of the oil pan apparatus. Meanwhile, the oil temperature sensor, which is used to check for an abnormality in the valve mechanism positioned as described above, may be mounted on the oil pan cover, which constitutes the outer cover of the oil pan apparatus. Thus, the valve mechanism can be checked for an abnormality while an extremely simple apparatus configuration is employed.

(5) Another feature of the present invention is that the configuration described under (1) to (4) includes a thermosensitive transformation section, which is configured so as to vary its shape in accordance with the oil temperature. A wax-based thermostat, bimetal, shape-memory alloy, or the like that changes its shape due, for instance, to thermal expansion/contraction or phase transformation may be used as the thermosensitive transformation section.

Abnormalities in the valve mechanism described above differ from abnormalities in a solenoid valve mechanism, hydraulic valve mechanism, or other valve mechanism that is operated by using an external electrical signal or fluid pressure (the latter abnormalities can easily be judged directly from the outside when an abnormality in the electrical signal or pressure is detected), and cannot readily be judged directly from the outside. However, when the configuration according to the present invention is employed, abnormalities in the valve mechanism can easily be judged in accordance with the output from the oil temperature sensor.

(6) Another feature of the present invention is that the judgment section included in the configuration described under (1) to (5) checks the valve mechanism for an abnormality by examining an output signal generated by the oil temperature sensor and an output signal generated by a water temperature sensor. The water temperature sensor is provided in the lubrication target mechanism to output a signal in accordance with the temperature of cooling water for cooling the lubrication target mechanism.

The output signal generated by the water temperature sensor faithfully represents the operation of the lubrication target mechanism. When the valve mechanism is checked for an abnormality in accordance with the output signal from the water temperature sensor and the output signal from the oil temperature sensor, it is possible to formulate accurate abnormality judgment.

BEST MODE FOR CARRYING OUT THE INVENTION

Embodiments of the present invention (embodiments that are considered to be the best by the applicant at the time of application of the present invention) will now be described with reference to the accompanying drawings.

<Engine Configuration Overview>

Figure 1:
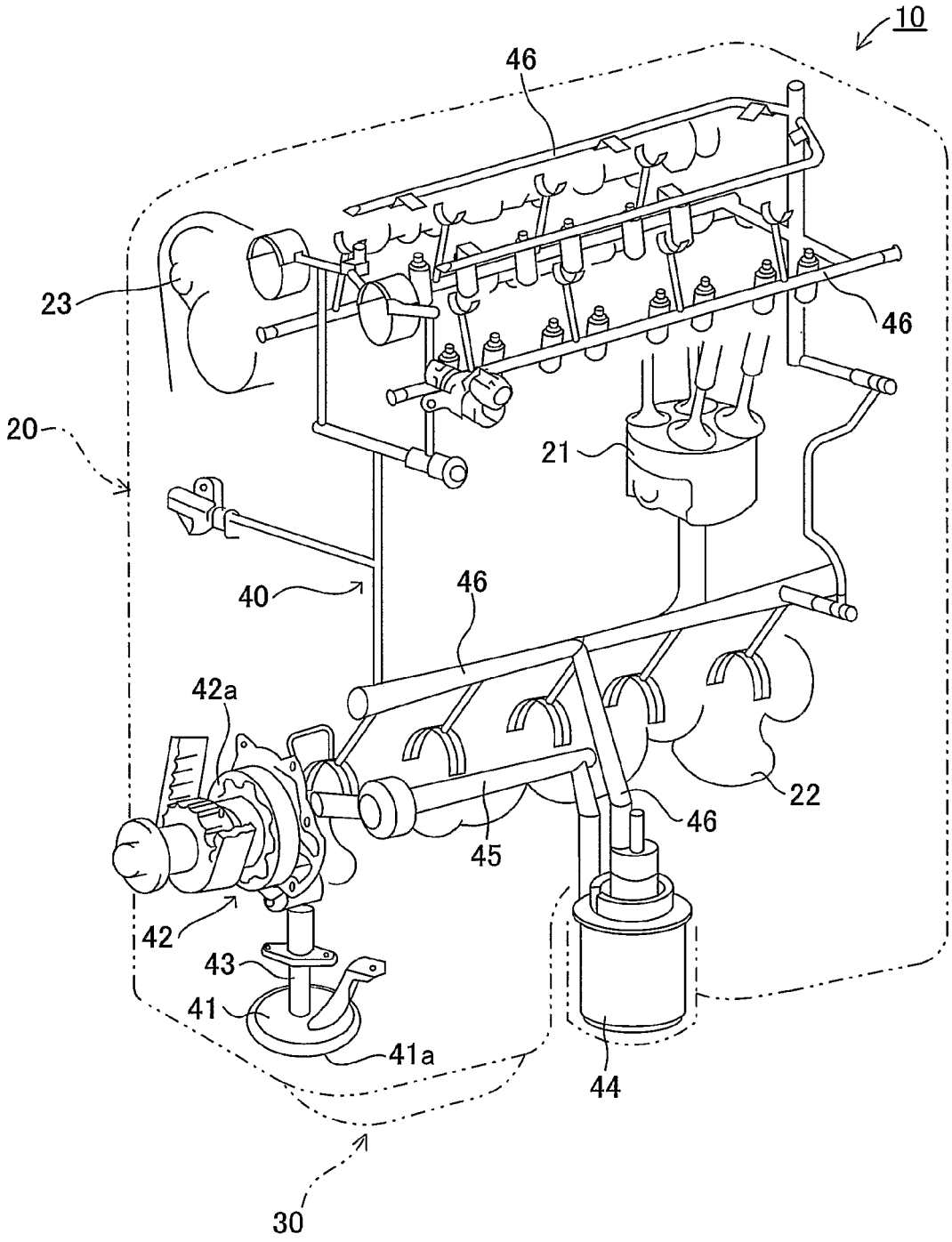
FIG. 1 is a schematic configuration of an engine that includes an oil pan apparatus according to an embodiment of the present invention.

FIG. 1 schematically shows the configuration of an engine 10 that includes an oil pan apparatus according to an embodiment of the present invention. The engine 10 includes a main body section (engine block) 20, which is a lubrication target mechanism that includes a cylinder head and a cylinder block, an oil pan apparatus 30 according to an embodiment of the present invention, which is connected to a lower end of the engine block 20, and a lubrication system 40, which supplies oil for lubricating the interior of the engine 10 to various parts of the engine 10.

The engine block 20 contains a plurality of lubrication target members, including a piston 21, a crankshaft 22, and a camshaft 23. The lower end of the engine block 20 is connected to the oil pan apparatus 30, which stores the oil to be supplied to the above lubrication target members.

The lubrication system 40 is configured as described below so that the oil stored inside the oil pan apparatus 30 can be supplied to the lubrication target members.

An oil strainer 41, which includes an intake port 41*a*, is positioned within an internal space of the oil pan apparatus 30. The intake port 41*a* is used to take in oil that is stored in the internal space of the oil pan apparatus 30. The oil strainer 41 is connected by means of an oil pump 42 and a strainer flow path 43, which are provided in the engine block 20.

The oil pump 42 comprises a well-known rotary pump. Its rotor 42*a* is coupled to the crankshaft 22 so that the rotor 42*a* rotates together with the crankshaft 22. The oil pump 42 is connected via an oil transport channel 45 to the oil inlet of an oil filter 44, which is provided outside the engine block 20. The oil outlet of the oil filter 44 is connected to an oil supply channel 46, which is provided as an oil flow path toward the lubrication target members.

Oil Pan Apparatus Configuration According to First Embodiment

Figure 2:
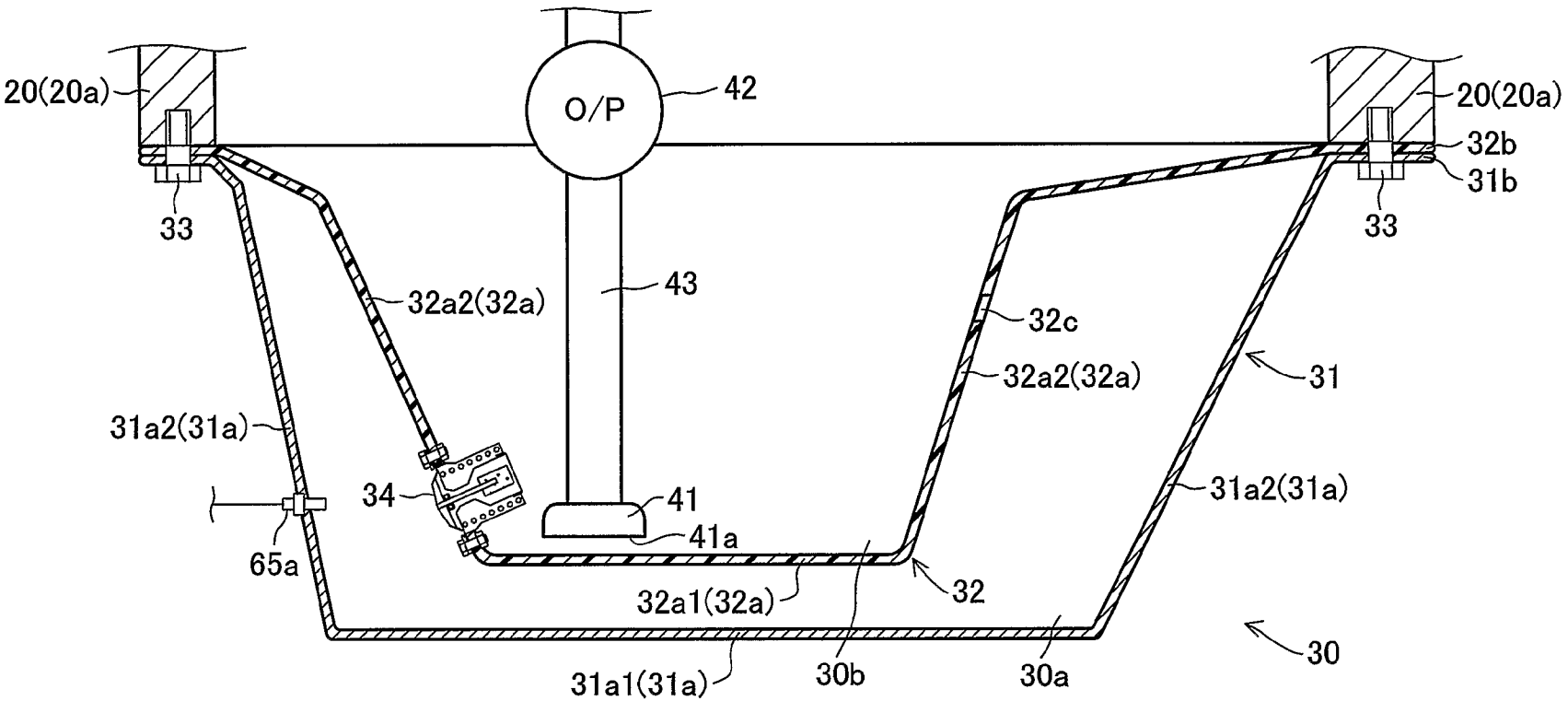
FIG. 2 is a lateral cross-sectional view that schematically illustrates an oil pan apparatus according to a first embodiment, which is applied to the engine shown in FIG. 1.

FIG. 2 is an enlarged lateral cross-sectional view illustrating a section of the oil pan apparatus 30 in the engine 10 that is shown in FIG. 1.

An oil pan cover 31 is a bathtub-shaped (concave) member that constitutes an outer cover of the oil pan apparatus 30. It is formed by pressing a steel plate and constructed of one piece. The oil pan cover 31 includes an oil storage section 31*a*, which is shaped like a bathtub to store oil in the internal space. At a peripheral border of a bottom plate 31*a*1 of the oil pan cover 31, which constitutes the bottom surface of the oil storage section 31*a*, a side plate 31*a*2 is provided and oriented obliquely upward as indicated in FIG. 2 (so that the area enclosed by the side plate 31*a*2 increases with an increase in the height). A flange section 31*b* is formed so that it extends substantially in a horizontal direction from the upper border of the side plate 31*a*2 to the outside. The flange section 31*b* is fastened with bolts 33 to the lower end face of a cylinder block 20*a*. Further, the oil pan cover 31 is mounted on the engine block 20 in such a manner that the oil storage section 31*a* is open toward the cylinder block 20*a* that is contained in the engine block 20, which is positioned above.

An oil pan separator 32 is a member for partitioning the internal space of the oil storage section 31*a* into a first chamber 30*a* and a second chamber 30*b*. The first chamber 30*a* contains the oil strainer 41 and communicates with the cylinder block 20*a*. The second chamber 30*b* is adjacent to the first chamber 30*a*. The oil pan separator 32 is formed by injecting synthetic resin into a mold and constructed of one piece.

The oil pan separator 32 includes a bathtub-shaped oil storage section 32*a*, and is configured so that oil can be stored in an internal space of the oil storage section 32*a*. The intake port 41*a* of the oil strainer 41 is positioned at a predetermined short distance (e.g., approximately 10 mm) from a bottom plate 32*a*1 of the oil pan separator 32, which represents the lowest position in the oil storage section 32*a*. (The term "lowest position" refers to the lowest position that prevails in the direction of gravity when a predefined apparatus containing the engine 10 is placed on level ground and laterally viewed.) In other words, the internal space of the oil storage section 32*a* in the oil pan separator 32 forms the first chamber 30*a* in which the oil strainer 41 is positioned.

At a peripheral border of the bottom plate 32*a*1, a side plate 32*a*2 is provided and oriented obliquely upward as indicated in FIG. 2 (so that the area enclosed by the side plate 32*a*2 increases with an increase in the height). A flange section 32*b* is formed so that it extends substantially in a horizontal direction from the upper border of the side plate 32*a*2 to the outside. Since the flange section 32*b* is sandwiched between the lower end face of the cylinder block 20*a* and the flange section 31*b* of the oil pan cover 31, the oil pan separator 32 is supported within the space that is enclosed by the engine block 20 and oil pan cover 31. A predetermined gap is provided between the bottom plate 31*a*1 of the oil pan cover 31 and the bottom plate 32*a*1 placed at the lowest position of the oil storage section 32*a* in the oil pan separator 32. Further, a predetermined gap is also provided between the side plate 31*a*2 of the oil pan cover 31 and the side plate 32*a*2 of the oil pan separator 32. In other words, the second chamber 30*b*, which is an oil storage space enclosed by the oil pan cover 31 and oil pan separator 32, is formed below and laterally to the oil storage section 32*a* of the oil pan separator 32.

The upper to middle area of the side plate 32*a*2 is provided with a plurality of upper communication holes 32*c* (e.g., circular holes approximately 8 to 10 mm in diameter or polygonal or oval holes similar in area to the circular holes) through which low-temperature, high-viscosity oil readily passes during a warm-up operation. The upper communication holes 32*c* are provided to adjust the oil levels in the first chamber 30*a* and second chamber 30*b* when the engine 10 shown in FIG. 1 is stopped or the oil in the first chamber 30*a* is taken in via the oil strainer 41 after completion of a warm-up operation.

The bottom section of the side plate 32*a*2 is provided with a thermostat valve apparatus 34. The thermostat valve apparatus 34 is through the side plate 32*a*2 and positioned nearly at the same height as the upper end of the intake port 41*a* of the oil strainer 41. The configuration of the thermostat valve apparatus 34 will now be described with reference to FIG. 3.

<<Thermostat Valve Apparatus Configuration>>

Figure 3:
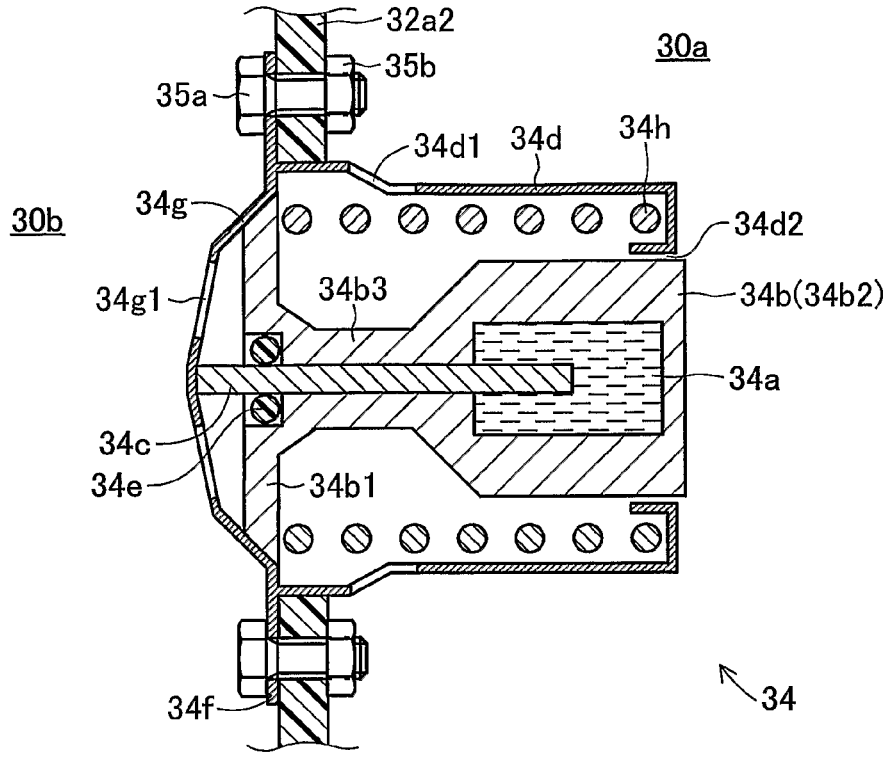
FIG. 3 is a Enlarged lateral cross-sectional views illustrating a thermostat valve apparatus that is included in the oil pan apparatus shown in FIG. 2.
Figure 3:
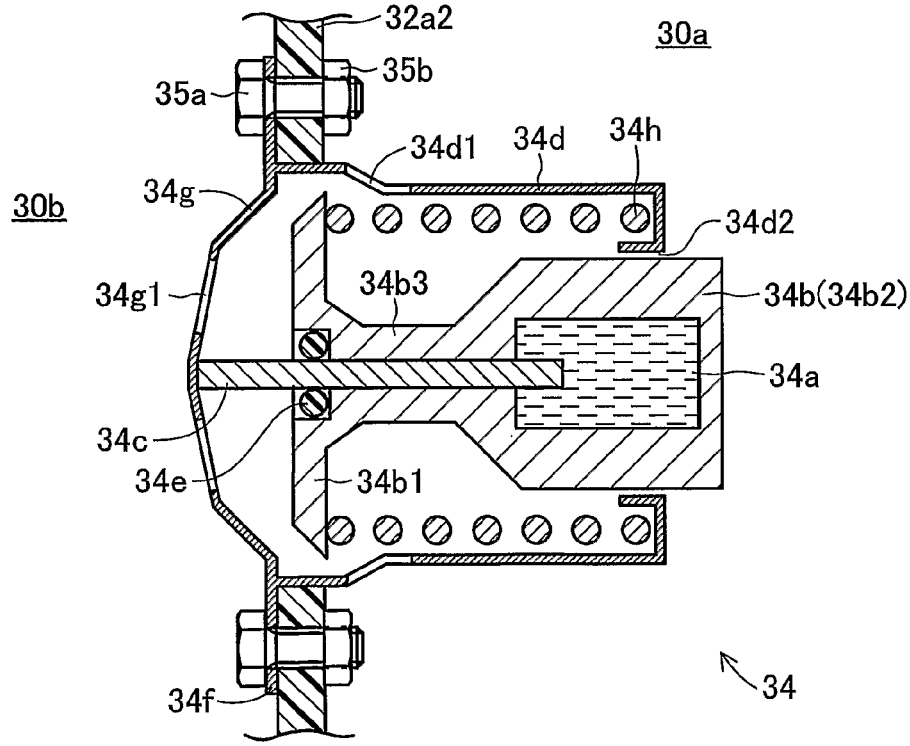

FIG. 3 are enlarged lateral cross-sectional views illustrating the thermostat valve apparatus 34. FIG. 3(*a*) shows a situation where the valve is closed at a low temperature. FIG. 3(*b*) shows a situation where the valve is open at a high temperature.

The thermostat valve apparatus 34 includes a valve body 34*b* that is made of metal and filled with wax 34*a*. The valve body 34*b* includes: a valve disc 34*b*1, which has a through-hole at the center and substantially shaped like a circular disc; a main body section 34*b*2, which is substantially shaped like a cylindrical column and provided with a cavity that is filled with wax 34*a*; and a connection section 34*b*3, which is substantially shaped like a cylinder and used to connect the valve disc 34*b*1 to the main body section 34*b*2. A rod 34*c* is positioned inside the cylinder that is formed by the connection section 34*b*3. One end of the rod 34*c* is exposed to the cavity filled with wax 34*a*, and the other end is exposed to the outside of the valve body 34*b* from the through-hole at the center of the valve disc 34*b*1. The wax 34*a*, valve body 34*b*, and rod 34*c* are used to form a thermosensitive transformation section that can vary its shape in accordance with the oil temperature. The wax 34*a*, which constitutes a thermosensitive section of the thermosensitive transformation section, and the main body section 34*b*2, which is filled with the wax 34*a*, are enclosed by a housing 34*d*, which is a metallic member that is substantially shaped like a cylinder. The thermostat valve apparatus 34 is positioned in such a manner that the main body section 34*b*2 and housing 34*d* are positioned toward the first chamber 30*a*. A sealant 34*e* is inserted into the through-hole in the valve disc 34*b*1 for sealing purposes so that the wax 34*a*, which is filled into the valve body 34*b*, does not leak out of the valve body 34*b*.

The housing 34*d* is provided with a first chamber side opening 34*d*1, which is a through-hole. The first chamber side opening 34*d*1 permits the internal space of the housing 34*d* to communicate with an external space (first chamber 30*a*). One end of the housing 34*d* is provided with a through-hole 34*d*2. This through-hole 34*d*2 is positioned so that the main body section 34*b*2 of the valve body 34*b*, which is filled with the wax 34*a*, is exposed to the first chamber 30*a*. Further, the main body section 34*b*2 of the valve body 34*b* can move (slide) inside this through-hole 34*d*2.

The other end of the housing 34*d* is provided with a flange section 34*f*, which is shaped like a circular disc and extended outward. When bolts 35*a* and nuts 35*b* are tightened with the flange section 34*f* placed over the side plate 32*a*2 of the oil pan separator 32, the thermostat valve apparatus 34 is fastened to the side plate 32*a*2.

The inside of the flange section 34*f* is connected to a second chamber facing cover 34*g*, which is made of a plated member that is exposed toward the second chamber 30*b*. The second chamber facing cover 34*g* is provided with a second chamber side opening 34*g*1, which is a through-hole. The other end of the rod 34*c*, which was mentioned earlier, is fastened to the second chamber facing cover 34*g*. The second chamber facing cover 34*g* (and valve disc 34*b*1) are shaped so that the valve disc 34*b*1 cuts off the communication between the internal space of the housing 34*d* and the internal space of the second chamber facing cover 34*g* when the second chamber facing cover 34*g* comes into contact with the valve disc 34*b*1.

The internal space of the housing 34*d* is provided with a coil spring 34*h* that is positioned to surround the valve body 34*b*. One end of the coil spring 34*h* is in contact with the valve disc 34*b*1, and the other end is in contact with the aforementioned one end of the housing 34*d*.

The thermostat valve apparatus 34 is such that if the oil temperature in the first chamber 30*a*, which is in contact with the main body section 34*b*2 of the valve body 34*b*, is lower than a predetermined valve opening temperature, the communication between the first chamber 30*a* and second chamber 30*b* breaks when the second chamber facing cover 34*g* comes into contact with the valve disc 34*b*1 as indicated in FIG. 3(*a*). If, on the other hand, the above-mentioned oil temperature is not lower than the predetermined valve opening temperature, the wax 34*a* melts to expand its cubic volume as indicated in FIG. 3(*b*). The aforementioned one end of the rod 34*c* is then pushed out of the cavity filled with the wax 34*a* so that the valve body 34*b* is pushed out toward the first chamber 30*a* against the pushing force of the coil spring 34*h*. A gap is then generated between the second chamber facing cover 34*g* and valve disc 34*b*1. Through the generated gap, an oil communication path is formed between the first chamber side opening 34*d*1 and second chamber side opening 34*g*1 and positioned inside the housing 34*d* (this communication path formed in the thermostat valve apparatus 34 is hereinafter simply referred to as "the oil communication path").

Due to the configuration described above, the thermostat valve apparatus 34 increases its valve opening ratio (the ratio of the current flow path cross-sectional area to the maximum flow path cross-sectional area of the oil communication path) in accordance with a temperature rise. The wax 34*a* expands in accordance with the oil temperature in the first chamber 30*a* that prevails near the thermostat valve apparatus 34. When the valve body 34*b* is placed at a position at which the force for pushing the valve body 34*b* toward the first chamber 30*a* due to wax expansion balances with the pushing force generated by the coil spring 34*h*, the status of the interchange of oil in the oil communication path varies with the oil temperature.

<Control System Configuration>

Figure 4:
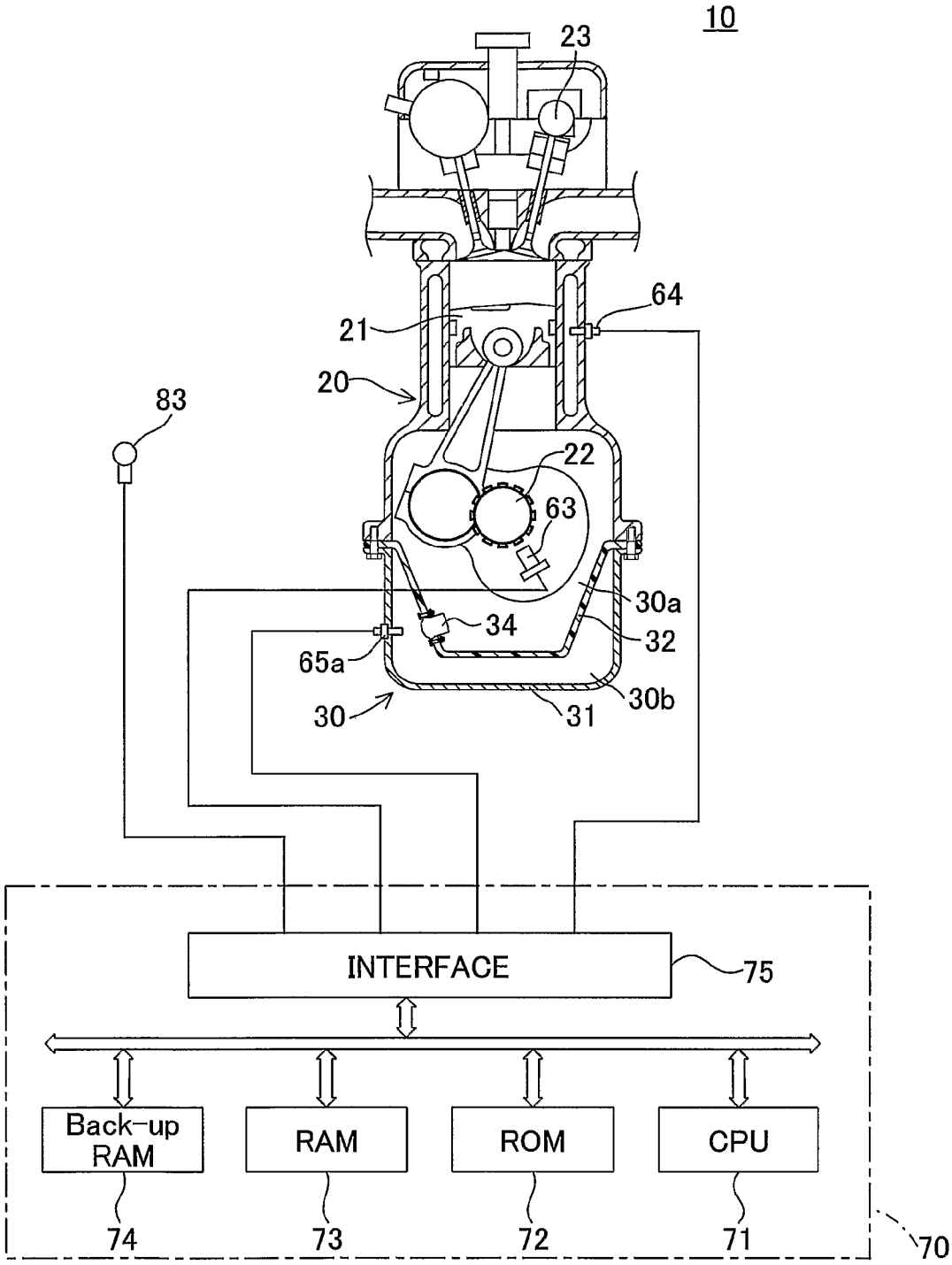
FIG. 4 is a schematic configuration of a control system for the engine shown in FIG. 1.

FIG. 4 schematically shows the configuration of a control system for the engine 10 according to the present embodiment (hereinafter simply referred to as the System). The System includes a crank position sensor 63, a water temperature sensor 64, and an oil temperature sensor 65*a*.

The crank position sensor 63 generates a narrow-width pulse each time the crankshaft 22 rotates 10°, and generates a wide pulse each time the crankshaft 22 rotates 360°. The water temperature sensor 64 detects the temperature of cooling water for cooling the engine 10, and outputs a signal that represents the cooling water temperature Tw. The oil temperature sensor 65*a* is mounted on the side plate 31*a*2 of the oil pan cover 31 from the outside and secured as indicated in FIG. 2. The oil temperature sensor 65*a* detects the temperature of oil in the second chamber 30*b*, and outputs a signal that represents the second chamber oil temperature Too. The oil temperature sensor 65*a* is positioned near the thermostat valve apparatus 34 so that when the thermostat valve apparatus 34 opens to invoke an oil flow between the first chamber 30*a* and second chamber 30*b*, the essential part of the oil temperature sensor 65*a*, which comes into contact with oil and detects the oil temperature to generate a signal in accordance with the oil temperature, is positioned in the oil flow.

Referring again to FIG. 4, an electrical control apparatus 70 is a microcomputer that comprises a CPU 71, a ROM 72, a RAM 73, a backup RAM 74, and an interface 75, which are interconnected via a bus. The ROM 72 stores routines (programs), tables (lookup table and map), parameters, and other data that are executed or otherwise handled by the CPU 71. These data pieces are stored in such a manner that they can be read by the CPU 71. The CPU 71 temporarily stores data in the RAM 73 as needed. The backup RAM 74 not only can store data while the power is on, but also retains the stored data while the power is off. The interface 75 is connected to the aforementioned sensors 63 to 65. It receives signals from the sensors 63 to 65 and supplies the received signals to the CPU 72. Further, it can supply a signal to a warning lamp 83 for the purpose of illuminating the warning lamp 83 in compliance with instructions from the CPU 71.

Operations Performed In Accordance With An Embodiment

The operations performed by the oil pan apparatus 30 according to the present embodiment, which is configured as described above, will now be described.

Due to a negative pressure that is generated at the intake port 41*a* of the oil strainer 41 in the first chamber 30*a* during an operation of the oil pump 42 (see FIG. 1), the oil in the first chamber 30*a* is taken in from the intake port 41*a* and supplied to the lubrication target mechanism via the oil pump 42. When a warm-up operation is being performed, the thermostat valve apparatus 34 is closed as indicated in FIG. 3(*a*). In other words, the low-temperature oil in the lower part of the second chamber 30*b* is effectively prevented from flowing into the first chamber 30*a* through the oil communication path within the thermostat valve apparatus 34 during a warm-up operation. Therefore, the oil supplied to the lubrication target members during a warm-up operation is virtually limited to the oil in the first chamber 30*a*. Thus, the progress of the warm-up operation is accelerated.

After completion of the warm-up operation, the thermostat valve apparatus 34 opens as indicated in FIG. 3(*b*) so that the oil communication path is formed between the first chamber side opening 34*d*1 and second chamber side opening 34*g*1. In this instance, the thermostat valve apparatus 34 is influenced by the negative pressure. The negative pressure allows the oil to flow from the second chamber 30*b* to the first chamber 30*a* via the oil communication path in the thermostat valve apparatus 34. When the oil flows from the second chamber 30*b* to the first chamber 30*a* via the oil communication path as mentioned above, the oil in the upper part of the first chamber 30*a* flows into the second chamber 30*b* via the upper communication holes 32*c*. In the manner described above, the low-temperature oil in the bottom part of the second chamber 30*b* flows into the first chamber 30*a* through the oil communication path. At the same time, the high-temperature oil in the upper part of the first chamber 30*a* flows into the second chamber 30*b* via the upper communication holes 32*c*. The oil then circulates within the oil pan apparatus 30. In this manner, the entire oil in the oil pan apparatus 30 is used to lubricate the lubrication target members. As a result, it is possible to prevent the engine 10 (see FIG. 1) from overheating without degrading the oil durability.

As described earlier, the thermostat valve apparatus 34 is configured so that the valve opening ratio gradually increases with an increase in the temperature. Therefore, the valve opening ratio of the thermostat valve apparatus 34 is low and the inflow amount of low-temperature oil stored in the lower part of the second chamber is small immediately after the valve opening temperature is reached by the oil around the thermostat valve apparatus 34 with the warm-up operation terminated. Consequently, the low-temperature oil does not flow into the first chamber 30*a* in large quantities and become taken in via the intake port 41*a* of the oil strainer 41. As a result, it is possible to prevent the low-temperature oil from being supplied in large quantities to the lubrication target members to rapidly cool the lubrication target members.

<<Oil Temperature Changes>>

Figure 5:
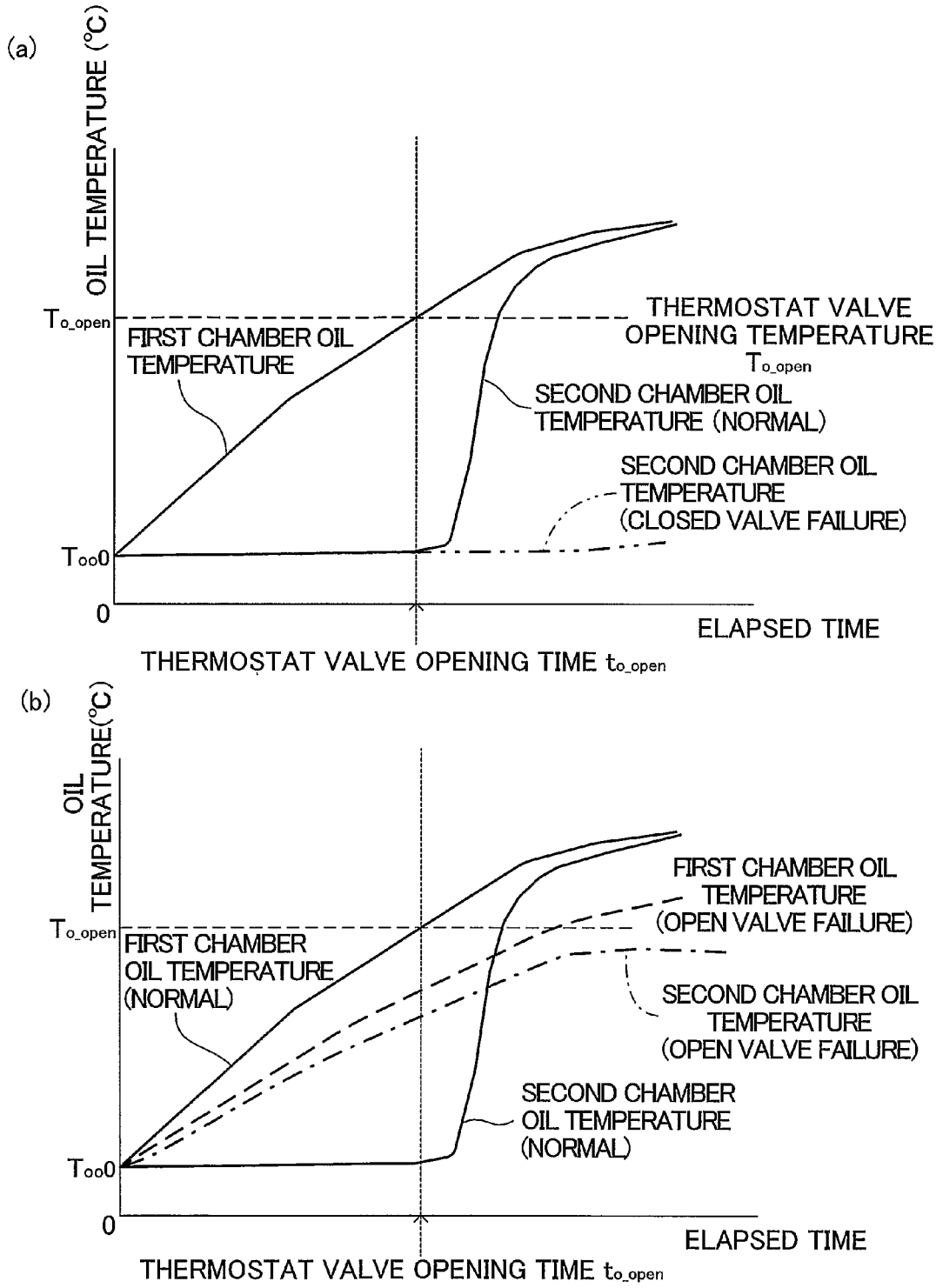
FIG. 5 is Graphs illustrating the relationship between the oil temperature and the operation of the engine shown in FIG. 1.

Changes in the oil temperature in the first chamber 30*a* (hereinafter referred to as the first chamber oil temperature) and changes in the oil temperature in the second chamber 30*b* (hereinafter referred to as the second chamber oil temperature) will now be described with reference to FIGS. 2 to 5. FIG. 5 are graphs illustrating changes in the first chamber oil temperature and second chamber oil temperature that are encountered after engine startup. FIG. 5 are prepared on the assumption that the first and second chamber oil temperatures are equal at the time of engine startup because a sufficiently long period of time has elapsed since last engine shutdown.

(Normal State)

As indicated in FIGS. 5(*a*) and 5(*b*), the first and second chamber oil temperatures are equal (initial oil temperature Too0) at the time of engine startup. Before completion of a warm-up operation, that is, when the first chamber oil temperature is lower than the valve opening temperature To_open of the thermostat valve apparatus 34, the thermostat valve apparatus 34 is closed as described earlier. Therefore, the interchange of oil does not occur in the oil communication path between the first chamber 30*a* and second chamber 30*b* so that only the oil in the first chamber 30*a* circulates between the lubrication target members and oil pan apparatus 30 (for the purpose of lubricating and cooling the lubrication target members). In this instance, as indicated by solid lines in FIG. 5, the first chamber oil temperature rises with time (as the warm-up operation for the lubrication target mechanism progresses), whereas the second chamber oil temperature hardly rises.

When the first chamber oil temperature subsequently reaches the valve opening temperature To_open of the thermostat valve apparatus 34 (it is assumed that the resulting elapsed time is to_open), the thermostat valve apparatus 34 begins to open, thereby invoking the interchange of oil in the oil communication path between the first chamber 30*a* and second chamber 30*b*. Consequently, the second chamber oil temperature begins to rise greatly as indicated by solid lines in FIG. 5. When the entire oil in the oil pan apparatus 30, including the first chamber 30*a* and second chamber 30*b*, begins to circulate through the lubrication target mechanism, the difference between the first chamber oil temperature and second chamber oil temperature decreases.

(Closed Valve Failure)

If, for instance, the sealant 34*e* for the thermostat valve apparatus 34 deteriorates so that the wax 34*a*, which is filled into the valve body 34*b*, leaks out of the valve body 34*b*, the thermostat valve apparatus 34, which is closed as indicated in FIG. 3(*a*), cannot open as indicated in FIG. 3(*b*) even when the first chamber oil temperature rises. This phenomenon is a closed valve failure. When the closed valve failure occurs, the interchange of oil does not occur in the oil communication path between the first chamber 30*a* and second chamber 30*b* even when the elapsed time exceeds the predetermined time to_open. In this instance, the second chamber oil temperature hardly rises as indicated by a two-dot chain line in FIG. 5(*a*). In the configuration according to the present embodiment, the oil temperature sensor 65*a* acquires the amount or rate of second chamber oil temperature rise when the elapsed time exceeds the predetermined time to_open. When the acquired amount or rate of second chamber oil temperature rise is smaller than a predetermined value, the CPU 71 judges that a closed valve failure has occurred. When it is judged that a closed valve failure has occurred, the CPU 71 feeds a signal to the warning lamp 83 via the interface 75 to illuminate the warning lamp 83.

(Open Valve Failure)

If, for instance, any foreign matter is caught between the second chamber facing cover 34*g* and valve disc 34*b*1 of the thermostat valve apparatus 34 after termination of a warm-up operation during the operation of the engine 10, the thermostat valve apparatus 34 is left open as indicated in FIG. 3(*b*) even when the engine 10 shuts down subsequently to lower the first chamber oil temperature. This phenomenon is an open valve failure. When the open valve failure occurs, the interchange of oil occurs in the oil communication path between the first chamber 30*a* and second chamber 30*b* immediately after engine startup. In other words, the entire oil in the oil pan apparatus 30, including the first chamber 30*a* and second chamber 30*b*, begins to circulate through the lubrication target mechanism immediately after engine startup. Therefore, as indicated by a broken line in FIG. 5(*b*), the first chamber oil temperature rise is slower than in the normal state, which is indicated by a solid line. The second chamber oil temperature also rises with an increase in the first chamber oil temperature immediately after engine startup, as indicated by a one-dot chain line in FIG. 5(*b*). Therefore, if the difference between the second chamber oil temperature and the initial oil temperature Too0 is greater than a predetermined value before the elapsed time reaches the predetermined time to_open in a situation where the configuration according to the present embodiment is employed, the CPU 71 judges that an open valve failure has occurred. When it is judged that an open valve failure has occurred, the CPU 71 feeds a signal to the warning lamp 83 via the interface 75 to illuminate the warning lamp 83.

<<Typical Failure Judgment Process>>

A concrete example of the above failure judgment process will now be described with reference to a flowchart in FIG. 6. The CPU 71 executes a "thermostat failure judgment process" routine 600, which is indicated in the flowchart in FIG. 6, immediately after engine startup.

First of all, the CPU 71 performs step 605 to acquire the initial oil temperature Too0, which is the second chamber oil temperature prevailing immediately after engine startup, in accordance with the output from the oil temperature sensor 65*a*.

Next, the CPU 71 performs step 610 to reset the count reached by a timer t and let the timer t start counting.

Next, the CPU 71 proceeds to step 615 and judges whether the initial oil temperature Too0 is lower than a predetermined temperature that is lower by a predetermined value ΔT0 than the valve opening temperature To_open of the thermostat valve apparatus 34 (Too0<To_open−ΔT0). As the predetermined value ΔT0, a numerical value greater than zero (e.g., a value between 0 and 20) can be selected as appropriate.

(A) If the initial oil temperature Too0 is lower than the predetermined temperature (when the query in step 615 is answered "Yes"), the engine 10 is cold started and being warmed up. Therefore, the CPU 71 proceeds to step 620 and waits until the elapsed time (the count reached by the timer t) reaches a predetermined value t1. As the predetermined value t1, an appropriate value is set in accordance with the initial oil temperature Too0 and a predefined table stored in the ROM 72 (see FIG. 4). This appropriate value should be such that the engine 10 is being warmed up with the first chamber oil temperature raised to a certain degree and before the end of a warm-up operation (that is, the elapsed time has not reached the thermostat valve opening time to_open). The term "(oil pan's) thermostat valve opening time to_open" refers to the elapsed time that is required for the first chamber oil temperature (solid line) to reach the valve opening temperature To_open of the thermostat valve apparatus 34 when the thermostat valve apparatus 34 is normal (no open valve failure or closed valve failure exists).

When the elapsed time from engine startup is equal to the predetermined value t1 (when the query in step 620 is answered "Yes"), the CPU 71 proceeds to step 625 and acquires the second chamber oil temperature rise ΔT=Too−Too0 immediately after engine startup. Next, the CPU 71 proceeds to step 630 and judges whether the temperature rise ΔT is smaller than a predetermined value ΔT1.

If the temperature rise ΔT is not smaller than the predetermined value ΔT1 (if the query in step 630 is answered "No"), it is judged that the second chamber oil temperature Too is higher than the initial oil temperature Too0 by more than the predetermined value ΔT1 although the elapsed time has not reached the thermostat valve opening time to_open. In other words, it is judged that an open valve failure has occurred. The CPU 71 then proceeds to step 635 and illuminates the warning lamp 83 to indicate the occurrence of the open valve failure. Next, the CPU proceeds to step 695 and terminates the routine.

If, on the other hand, the temperature rise ΔT is smaller than the predetermined value ΔT1 (if the query in step 630 is answered "Yes"), no open valve failure has occurred. Therefore, the CPU 71 proceeds to step 640 and waits until the elapsed time reaches a predetermined value t2. As the predetermined value t2, an appropriate value is set in accordance with the initial oil temperature Too0 and a predefined table stored in the ROM 72. This appropriate value should be such that when a predetermined period of time elapses after the thermostat valve apparatus 34 opens with the first chamber oil temperature rendered higher than the valve opening temperature To_open of the thermostat valve apparatus 34, the interchange of oil may occur between the first chamber 30*a* and second chamber 30*b* to make the second chamber oil temperature Too sufficiently higher than the initial oil temperature Too0 (that is, the elapsed time has exceeded the thermostat valve opening time to_open). When the elapsed time is equal to the predetermined value t2 (when the query in step 640 is answered "Yes"), the CPU 71 proceeds to step 645, acquires the aforementioned temperature rise ΔT=Too−Too0 in accordance with the current second chamber oil temperature Too, and judges whether the temperature rise ΔT is not smaller than a predetermined value ΔT2.

If the temperature rise ΔT is not smaller than the predetermined value ΔT2 (if the query in step 650 is answered "Yes"), the CPU 71 proceeds to step 655 and judges that the second chamber oil temperature Too is raised by more than a predetermined value after the thermostat valve opening time to_open is exceeded by the elapsed time (that is, no closed valve failure has occurred in the thermostat valve apparatus 34). The CPU 71 then proceeds to step 695 and terminates the routine.

If, on the other hand, the temperature rise ΔT is smaller than the predetermined value ΔT2 (if the query in step 650 is answered "No"), it is judged that the second chamber oil temperature is hardly raised although the thermostat valve opening time to_open is exceeded by the elapsed time, that is, a closed valve failure has occurred. Therefore, the CPU 71 proceeds to step 660 and illuminates the warning lamp 83 to indicate the occurrence of the closed valve failure. Next, the CPU proceeds to step 695 and terminates the routine.

(B) If the initial oil temperature Too0 is not lower than the predetermined temperature (when the query in step 615 is answered "No"), the current engine startup operation is a hot start, which does not require any warm-up operation. Therefore, the thermostat valve apparatus 34 opens immediately after engine startup so that the interchange of oil occurs in the oil communication path between the first chamber 30*a* and second chamber 30*b*. Consequently, an open valve failure judgment cannot be formulated. Therefore, the CPU 71 proceeds to step 640 and waits until the elapsed time reaches the predetermined value t2. As the predetermined value t2, an appropriate value, which may render the second chamber oil temperature Too sufficiently higher than the initial oil temperature Too0, is set in accordance with the initial oil temperature Too0 and a predefined table stored in the ROM 72. Subsequently, steps 640 to 695 are performed, as is the case with (A) above, to judge whether a closed valve failure has occurred.

As described above, the use of the configuration according to the present embodiment, that is, the use of a simple configuration in which the oil temperature sensor 65*a* that is mounted on the side plate 31*a*2 of the oil pan cover 31 from the outside and secured is used, makes it possible to judge easily whether an open valve failure or closed valve failure has occurred in the thermostat valve apparatus 34.

<<Another Typical Failure Judgment Process>>

Figure 7:
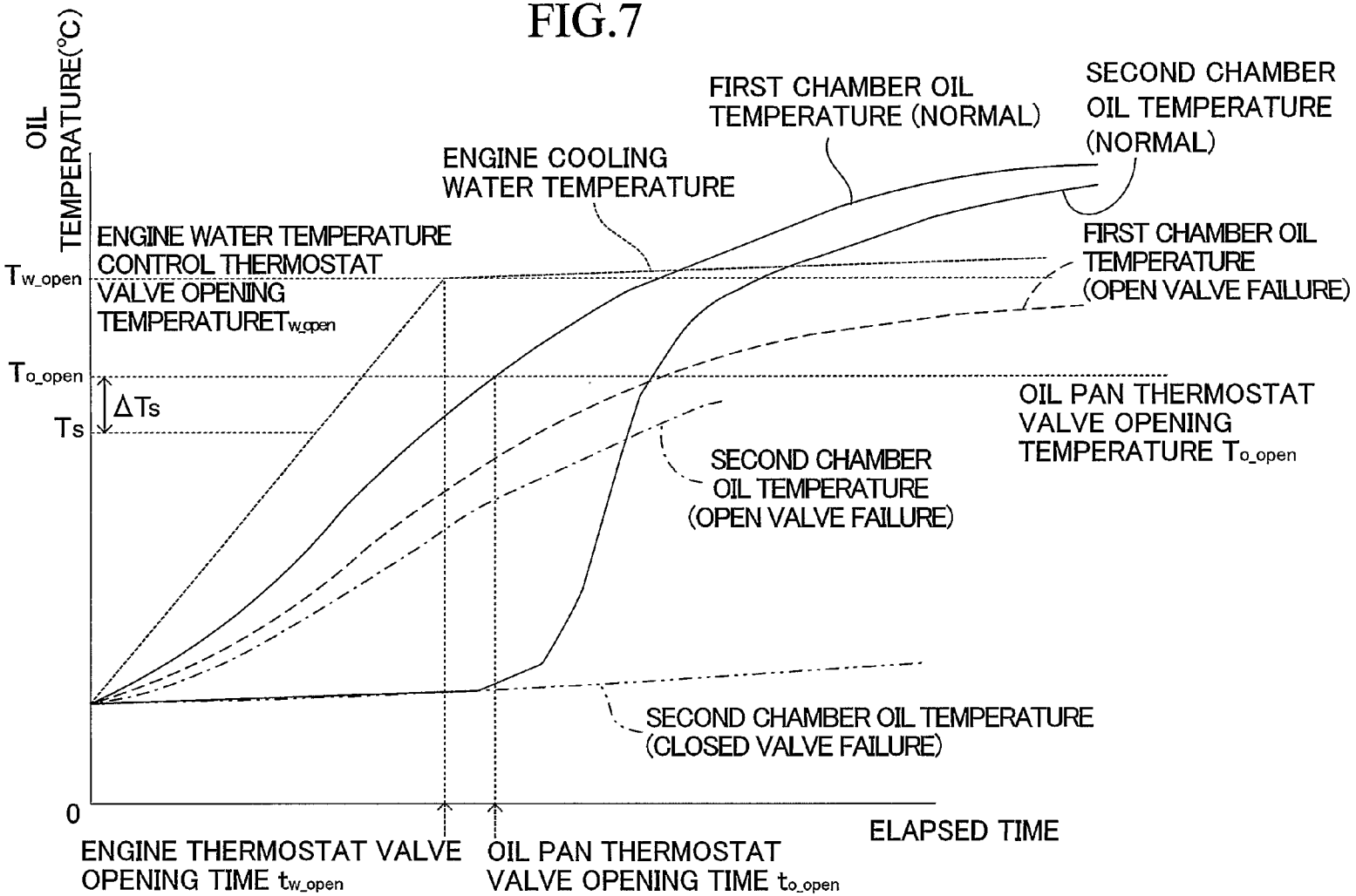
FIG. 7 is a graph illustrating the relationship among the oil temperature, the water temperature, and the operation of the engine shown in FIG. 1.
Figure 8:
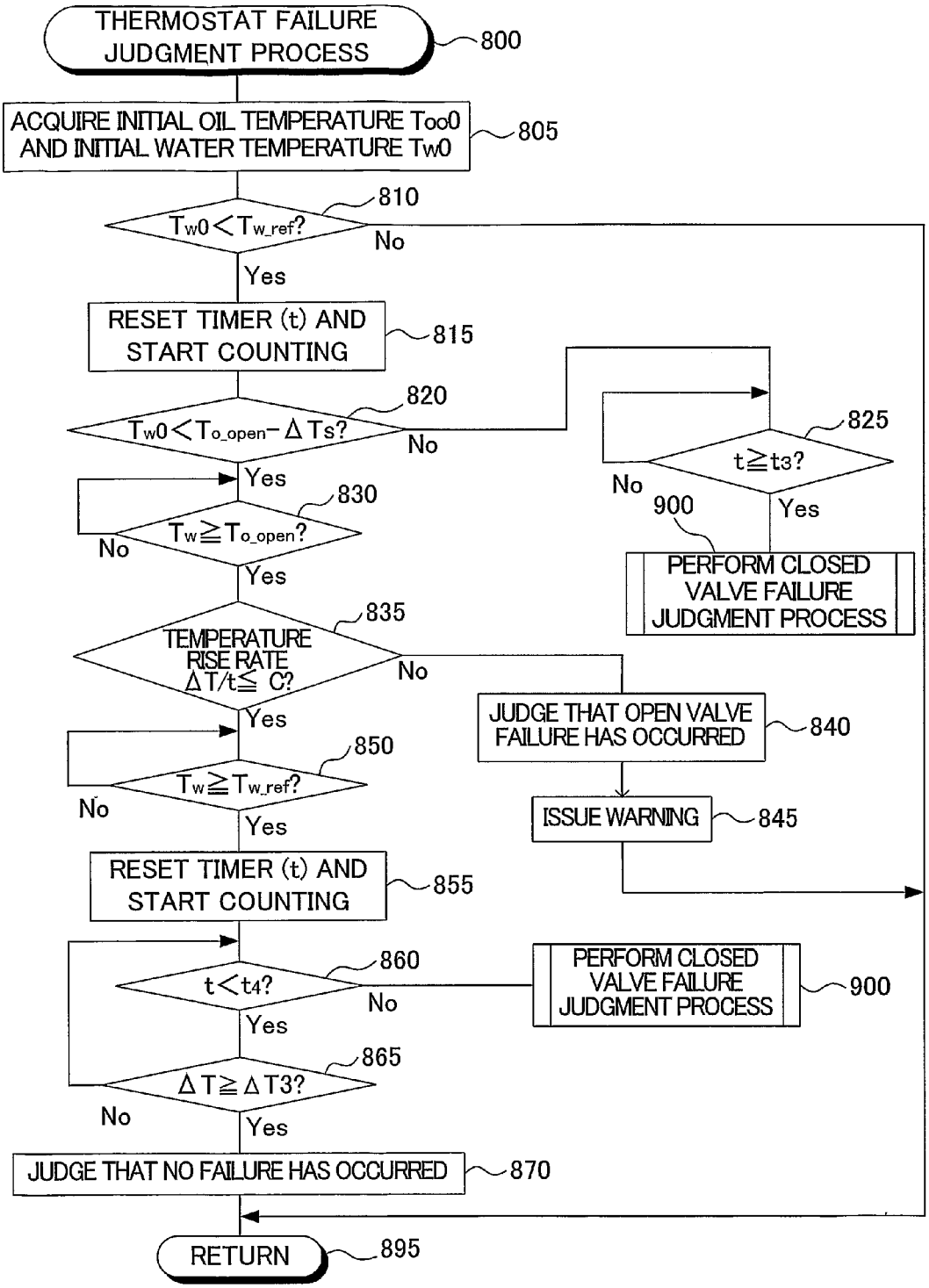
FIG. 8 is a flowchart illustrating another example of a thermostat valve apparatus abnormality judgment process that is performed by the control system shown in FIG. 4.
Figure 9:
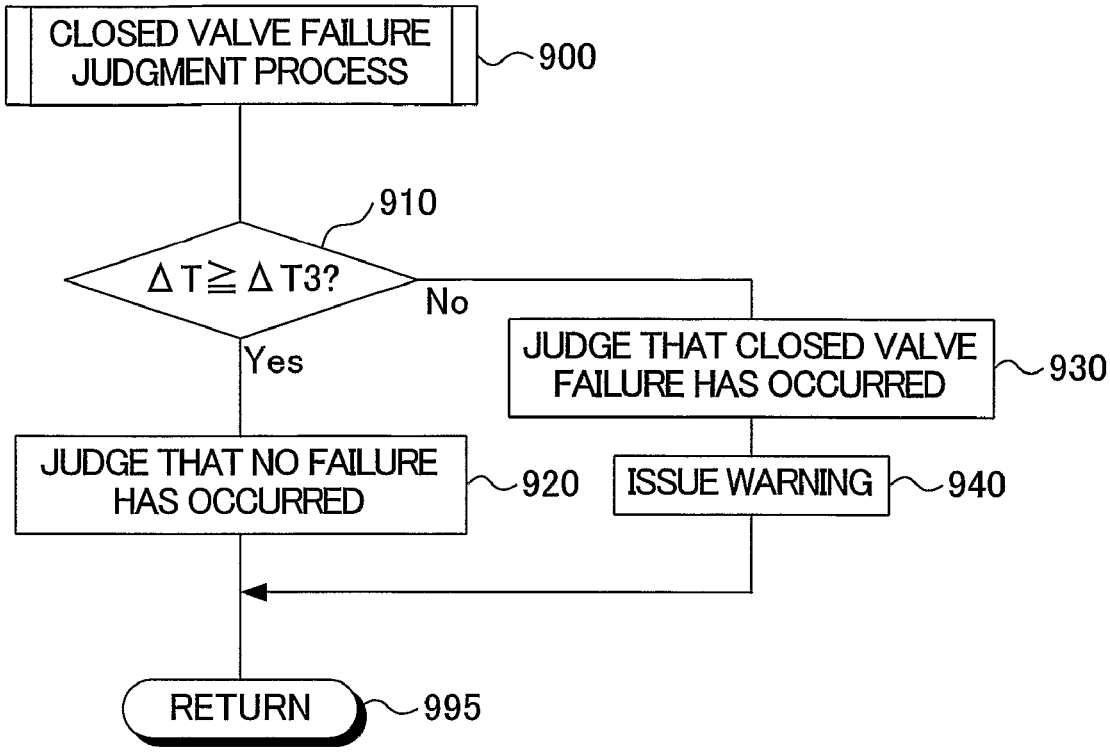
FIG. 9 is a flowchart illustrating a concrete example of a subroutine for a closed valve failure judgment process that is illustrated in the flowchart in FIG. 8.

Another concrete example of the failure judgment process will now be described with reference to FIGS. 2 to 4 and 7 to 9. FIG. 7 is a graph illustrating first chamber oil temperature and second chamber oil temperature changes (the same as indicated in FIG. 5) and engine cooling water temperature changes (dotted line) that are encountered since engine startup. FIG. 8 is a flowchart illustrating a thermostat failure judgment process according to another concrete example. FIG. 9 is a flowchart illustrating a concrete example of a subroutine for a closed valve failure judgment process 900 that is illustrated by the flowchart in FIG. 8.

As indicated in FIG. 4, the cooling water temperature Tw for the engine 10 is acquired at a position that is closer to the lubrication target members than the second chamber oil temperature Too in the oil pan apparatus 30. Further, as indicated in FIG. 7, the thermostat valve opening time to_open of the oil pan is close to the thermostat valve opening time tw_open of the engine (the elapsed time required for the cooling water temperature Tw to reach the thermostat valve opening temperature Tw_open for controlling the temperature of the cooling water contained in the cooling water circulation system for the engine 10). As described above, the behavior of the engine cooling water temperature Tw is similar to that of the first chamber oil temperature. The engine cooling water temperature Tw reflects the operation (particularly the warm-up state) of the engine block 20, which is the lubrication target mechanism, with increased fidelity. Therefore, the failure judgment process according to the present embodiment identifies a failure in the thermostat valve apparatus 34 with increased accuracy by using not only the output from the oil temperature sensor 65*a* but also the engine cooling water temperature Tw of the engine 10, which is based on the output from the water temperature sensor 64.

The CPU 71 executes a "thermostat failure judgment process" routine 800, which is indicated in the flowchart in FIG. 8, immediately after engine startup.

First of all, the CPU 71 proceeds to step 805 and acquires the initial oil temperature Too0 and initial water temperature Tw0 that prevail immediately after engine startup in accordance with the outputs from the oil temperature sensor 65*a* and water temperature sensor 64.

Next, the CPU 71 proceeds to step 810 and judges whether the initial water temperature Tw0 is lower than a predetermined value Tw_ref.

If the initial water temperature Tw0 is not lower than the predetermined value Tw_ref (if the query in step 810 is answered "No"), the CPU 71 proceeds to step 895 and terminates the routine. When the engine is hot started (when, for instance, the engine is warmed up completely, operated for a long period of time, shut down, and then restarted immediately after shutdown), the second chamber oil temperature may be as high as the first chamber oil temperature prior to startup. In such a situation, it is basically impossible to properly formulate an open valve failure/closed valve failure judgment. In this instance, the CPU 71 does not check for a failure in the thermostat valve apparatus 34. As the predetermined value Tw_ref, a predetermined temperature (e.g., To_open+10° C. or so) that is sufficiently higher than the valve opening temperature To_open of the thermostat valve apparatus 34 is used.

If, on the other hand, the initial water temperature Tw0 is lower than the predetermined value Tw_ref (if the query in step 810 is answered "Yes"), the CPU 71 proceeds to step 815. In step 815, the CPU 71 resets the count reached by the timer t, and causes the timer t to start counting.

Next, the CPU 71 proceeds to step 820 and judges whether the initial water temperature Tw0 is lower than a predetermined temperature that is lower by a predetermined value ΔTs (e.g., approximately 10° C.) than the valve opening temperature To_open of the thermostat valve apparatus 34.

If the initial water temperature Tw0 is not lower than the predetermined temperature (if the query in step 820 is answered "No"), the first chamber oil temperature may reach the valve opening temperature To_open of the thermostat valve apparatus 34 immediately after startup and allow the second chamber oil temperature to rise. In such a situation, an open valve failure judgment is not properly formulated (an open valve failure may be erroneously located although the thermostat valve apparatus 34 properly operates). In this instance, the CPU 71 proceeds to step 825 and waits until the elapsed time from startup reaches a predetermined time t3 (e.g., 10 minutes or so). When the predetermined time t3 elapses, the CPU 71 performs a closed valve failure judgment process 900 (see FIG. 9). The predetermined time t3 is set in accordance with the initial water temperature Tw0 and/or the initial oil temperature Too0 and a predefined table stored in the ROM 72 (see FIG. 4).

If, on the other hand, the initial water temperature Tw0 is lower than the predetermined temperature (if the query in step 820 is answered "Yes"), the CPU 71 proceeds to step 830 and waits until the cooling water temperature Tw reaches the valve opening temperature To_open of the thermostat valve apparatus 34. When the cooling water temperature Tw reaches the valve opening temperature To_open of the thermostat valve apparatus 34 (when the query in step 830 is answered "Yes"), the CPU 71 proceeds to step 835 and judges whether an average oil temperature rise rate ΔT/t=(Too−Too0)/t is not higher than a predetermined value C.

If the average oil temperature rise rate ΔT/t is higher than the predetermined value C (if the query in step 835 is answered "No"), the CPU 71 proceeds to step 840 and judges that an open valve failure has occurred. The CPU 71 then proceeds to step 845 and illuminates the warning lamp 83 to indicate the occurrence of the open valve failure. Next, the CPU proceeds to step 895 and terminates the routine.

If, on the other hand, the average oil temperature rise rate ΔT/t is not higher than the predetermined value C (if the query in step 835 is answered "Yes"), it is judged that no open valve failure has occurred in the thermostat valve apparatus 34. In this instance, the CPU 71 proceeds to step 850 and waits until the current cooling water temperature Tw reaches the predetermined temperature Tw_ref, which is sufficiently higher than the valve opening temperature To_open of the thermostat valve apparatus 34. When the cooling water temperature Tw reaches the predetermined temperature Tw_ref (when the query in step 850 is answered "Yes"), the CPU 71 proceeds to step 855, resets the timer again, and causes the timer to start counting.

Next, the CPU 71 proceeds to steps 860 and 865, and judges whether the current second chamber oil temperature Too is higher than the initial oil temperature Too0 by more than a predetermined value ΔT3 (whether the rise value ΔT=Too−Too0≧ΔT3) before a predetermined time t4 elapses after a timer reset (when the query in step 860 is answered "Yes").

If the second chamber oil temperature rise value ΔT is not smaller than ΔT3 before the elapse of the predetermined time (t<t4) (if the queries in steps 860 and 865 are both answered "Yes"), the CPU 71 proceeds to step 870 and judges that no closed valve failure has occurred in the thermostat valve apparatus 34 (that is, the thermostat valve apparatus 34 is normal). Next, the CPU 71 proceeds to step 895 and terminates the routine.

If, on the other hand, the predetermined time t4 elapses after a timer reset while the second chamber oil temperature rise Δt is smaller than ΔT3 (if the query in step 860 is answered "No"), the CPU 71 performs the closed valve failure judgment process 900 (see FIG. 9).

FIG. 9 is a flowchart illustrating a concrete example of the closed valve failure judgment process 900 that is shown in FIG. 8. First of all, the CPU 71 proceeds to step 910 and judges whether the current second chamber oil temperature Too is higher than the initial oil temperature Too0 by more than the predetermined value ΔT3, as is the case with step 865 in the routine 800 described above. If the second chamber oil temperature rise ΔT is not smaller than ΔT3 (if the query in step 910 is answered "Yes"), the CPU 71 proceeds to step 920 and judges that no closed valve failure has occurred in the thermostat valve apparatus 34 (that is, the thermostat valve apparatus 34 is normal). Next, the CPU 71 proceeds to step 995 and terminates the routine. If, on the other hand, the second chamber oil temperature rise ΔT is smaller than ΔT3 (if the query in step 910 is answered "No"), the CPU 71 proceeds to step 930 and judges that a closed valve failure has occurred in the thermostat valve apparatus 34. Next, the CPU 71 proceeds to step 940 and illuminates the warning lamp 83 to indicate the occurrence of the closed valve failure. Finally, the CPU 71 proceeds to step 995 and terminates the routine.

As described above, the use of the configuration according to the present embodiment, that is, the use of a simple configuration in which the water temperature sensor 64 and oil temperature sensor 65*a* that may be mounted from the outside of the engine 10 and secured is used, makes it possible to judge properly and easily whether an open valve failure or closed valve failure has occurred in the thermostat valve apparatus 34.

Oil Pan Apparatus Configuration According To Second Embodiment

Figure 10:
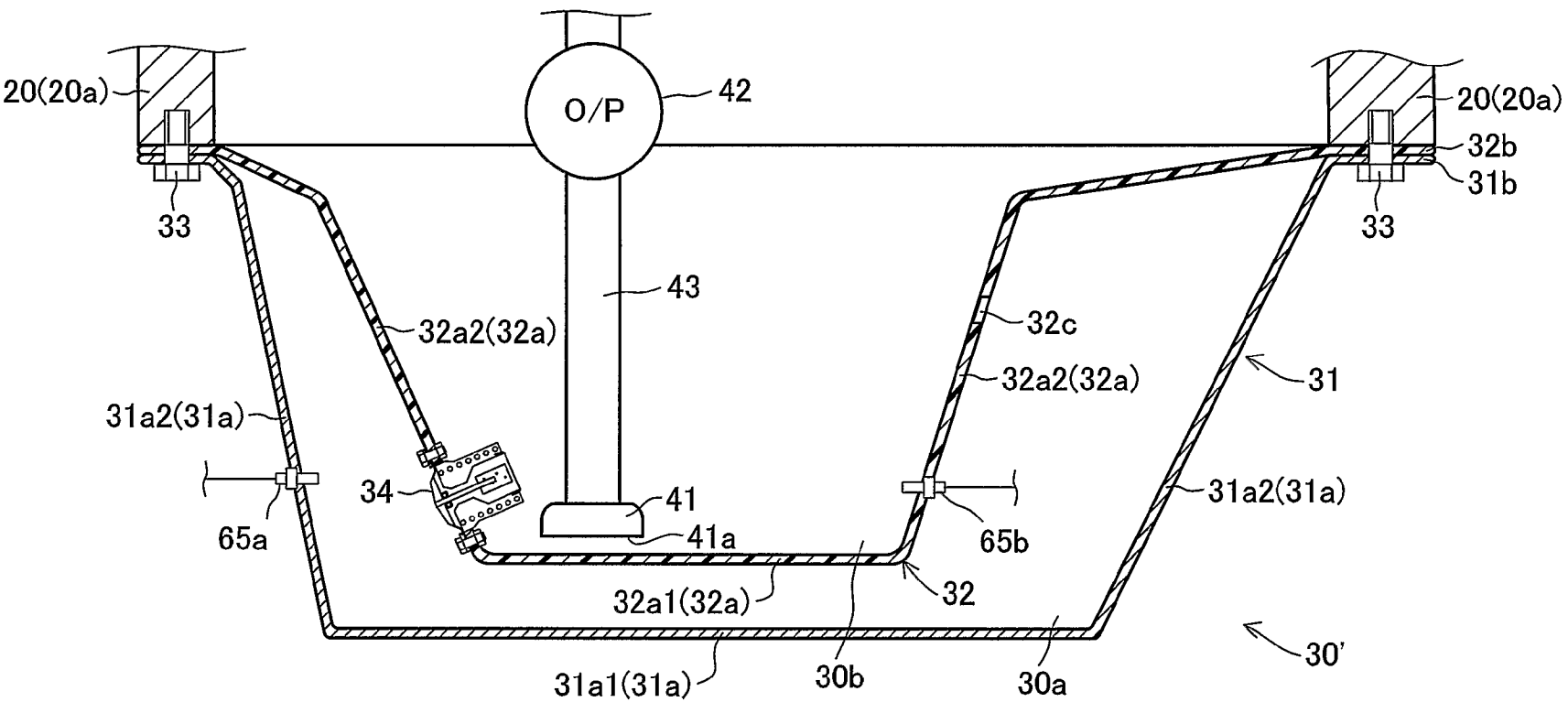
FIG. 10 is a lateral cross-sectional view that schematically illustrates an oil pan apparatus according to a second embodiment, which is applied to the engine shown in FIG. 1.

FIG. 10 is a lateral cross-sectional view that schematically illustrates the configuration of an oil pan apparatus 30' according to a second embodiment of the present invention. Elements common to the first embodiment described above will not be described herein. When such elements are depicted in the drawings, they are assigned the same reference numerals as those used in conjunction with the first embodiment.

The oil pan apparatus 30' according to the second embodiment has the same configuration as the oil pan apparatus 30 according to the first embodiment, and includes an oil temperature sensor 65*b* that is mounted on the side plate 32*a*2 of the oil pan separator 32 to acquire the temperature of the oil in the first chamber 30*a*. In the configuration according to the second embodiment, oil temperature sensors 65*a* and 65*b* are used to determine the actual behavior of the oil temperatures in the first and second chambers shown in FIG. 5 so that the thermostat valve apparatus 34 can be checked for an open valve failure/closed valve failure.

<<Typical Failure Judgment Process>>

A concrete example of a failure judgment process that is performed by the thermostat valve apparatus 34 according to the second embodiment will now be described with reference to a flowchart in FIG. 11.

Figure 11:
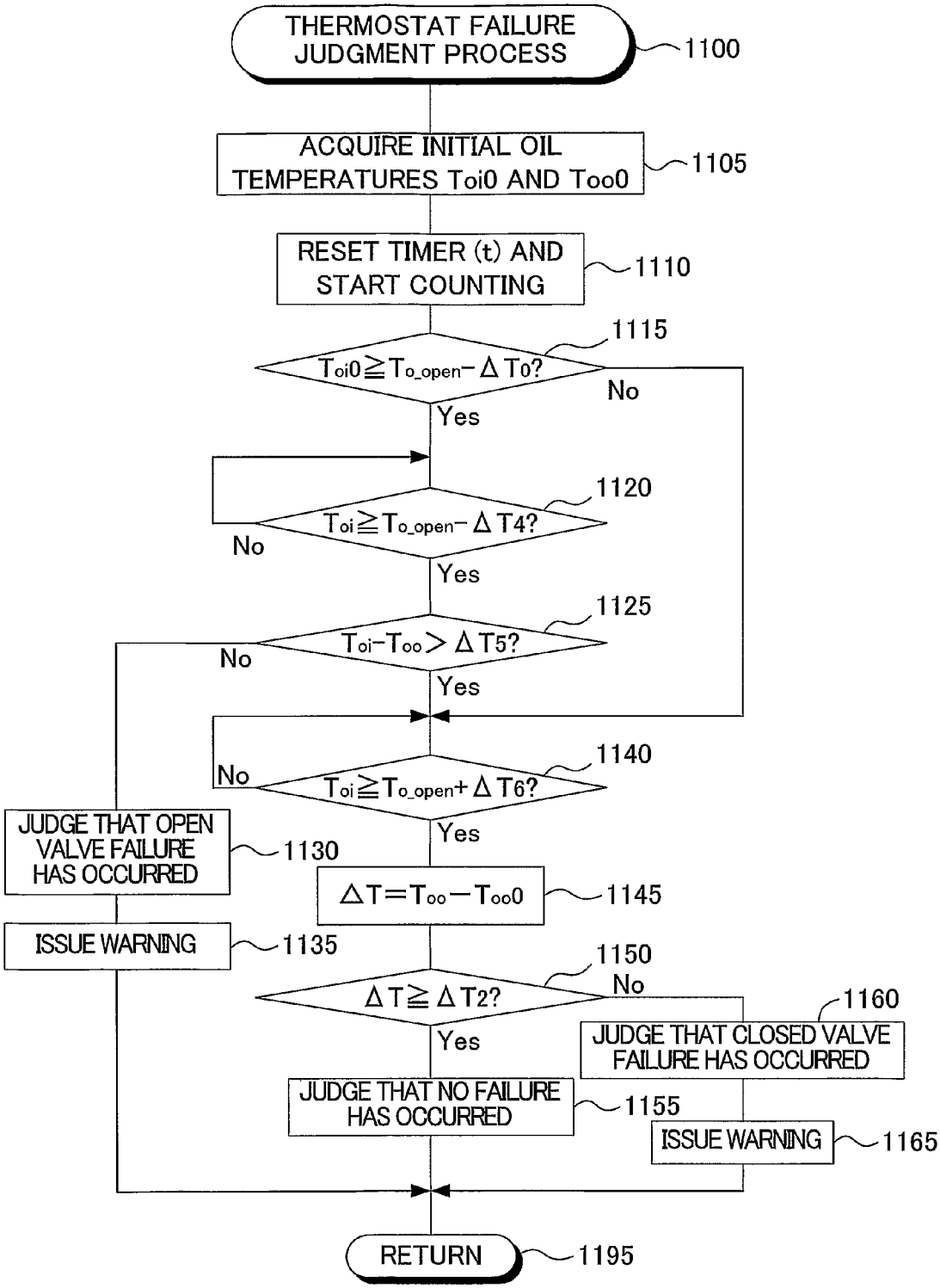
FIG. 11 is a flowchart illustrating a concrete example of a thermostat valve apparatus abnormality judgment process that is performed by the control system for the engine provided with the oil pan apparatus shown in FIG. 9.

The CPU 71 executes a "thermostat failure judgment process" routine 1100, which is indicated in the flowchart in FIG. 11, immediately after engine startup.

First of all, the CPU 71 proceeds to step 1105 and acquires the first chamber initial oil temperature Toi0 and second chamber initial oil temperature Too0, which prevail immediately after engine startup, in accordance with the outputs from the oil temperature sensors 65*a* and 65*b*.

Next, the CPU 71 proceeds to step 1110 and resets the count reached by the timer t and let the timer t start counting.

Next, the CPU 71 proceeds to step 1115 and judges whether the first chamber initial oil temperature Toi0 is lower than a predetermined temperature that is lower by a predetermined value ΔT0 than the valve opening temperature To_open of the thermostat valve apparatus 34 (Too0<To_open−ΔT0).

(A) If the initial oil temperature Toi0 is lower than the predetermined temperature (if the query in step 1115 is answered "Yes"), the engine 10 is cold started and being warmed up. Therefore, the CPU 71 proceeds to step 1120 and waits until the current first chamber oil temperature Toi is lower than the valve opening temperature To_open of the thermostat valve apparatus 34 but sufficiently higher than during a cold startup sequence (until the first chamber oil temperature Toi is equal to To_open−ΔT4). As the value ΔT4, a relatively small value, such as 10° C. or so, may be used. When the first chamber oil temperature Toi is equal to To_open−ΔT4 (when the query in step 1120 is answered "Yes"), the CPU 71 proceeds to step 1125 and judges whether the difference between the first chamber oil temperature Toi and second chamber oil temperature Too is greater than a predetermined value ΔT5. As the predetermined value ΔT5, a relatively small value, such as 5° C. or so, may be used.

If the difference between the first chamber oil temperature Toi and second chamber oil temperature Too is not greater than the predetermined value ΔT5 (if the query in step 1125 is answered "No"), the CPU 71 proceeds to step 1130 and judges that the second chamber oil temperature Too is raised to a level close to the first chamber oil temperature Toi although the current first chamber oil temperature Toi is lower than the valve opening temperature To_open of the thermostat valve apparatus 34, that is, an open valve failure has occurred. The CPU 71 then proceeds to step 1135 and illuminates the warning lamp 83 to indicate the occurrence of the open valve failure. Finally, the CPU 71 proceeds to step 1195 and terminates the routine.

If, on the other hand, the difference between the first chamber oil temperature Toi and second chamber oil temperature Too is greater than the predetermined value ΔT5 (if the query in step 1125 is answered "Yes"), no open valve failure has occurred. Therefore, the CPU 71 proceeds to step 1140 and waits until the current first chamber oil temperature Toi is higher than the valve opening temperature To_open of the thermostat valve apparatus 34 by a value ΔT6. As the value ΔT6, a temperature of 10° C. or so may be used. More specifically, the value ΔT6 should make it possible to expect that the second chamber oil temperature Too will be considerably higher than the initial temperature Too0 if, as indicated in FIG. 5, the thermostat valve apparatus 34 is normal (no closed valve failure exists) when an adequate amount of time has elapsed since the thermostat valve opening time to_open.

When the first chamber oil temperature Toi is higher than the valve opening temperature To_open of the thermostat valve apparatus 34 by ΔT6 (when the query in step 1140 is answered "Yes"), the CPU 71 proceeds to step 1145 and acquires the second chamber oil temperature rise ΔT=Too−Too0 since engine startup, as is the case with step 645 in the aforementioned routine 600. Next, the CPU 72 proceeds to step 1150, which is similar to step 650 in the aforementioned routine 600, and judges whether the temperature rise ΔT is smaller than the predetermined value ΔT2.

If the temperature rise ΔT is not smaller than the predetermined value ΔT2 (if the query in step 1150 is answered "Yes"), the CPU 71 proceeds to step 1155 and judges that no closed valve failure has occurred in the thermostat valve apparatus 34. Next, the CPU 71 proceeds to step 1195 and terminates the routine.

If, on the other hand, the temperature rise ΔT is smaller than the predetermined value ΔT2 (if the query in step 1150 is answered "No"), the CPU 71 proceeds to step 1160 and judges that a closed valve failure has occurred. The CPU 71 then proceeds to step 1165 and illuminates the warning lamp 83 to indicate the occurrence of the closed valve failure. Finally, the CPU 71 proceeds to step 1195 and terminates the routine.

(B) If the initial oil temperature Toi0 is not lower than the predetermined temperature (if the query in step 1115 is answered "No"), the current engine startup operation is a hot start, which does not require any warm-up operation. Therefore, the thermostat valve apparatus 34 opens immediately after engine startup so that the interchange of oil may occur in the oil communication path between the first chamber 30*a* and second chamber 30*b*. Consequently, an open valve failure judgment cannot be formulated. Therefore, the CPU 71 proceeds to step 1140 and performs steps 1140 to 1165 to check for a closed valve failure. Finally, the CPU 71 proceeds to step 1195 and terminates the routine.

Some More Examples Of Modified Embodiments

The foregoing embodiments and concrete examples are considered to be the best by the applicant at the time of application of the present invention, as mentioned earlier. They are to be considered in all respects only as illustrative and not restrictive. The present invention is not limited to the foregoing embodiments, but extends to various modifications that does not change the essential part of the present invention. Although some modified embodiments are described below, they are also to be considered only as illustrative and not restrictive.

The configuration of the oil pan apparatus according to the present invention can be applied not only to the aforementioned engine but also to an automatic transmission and various other apparatuses that are equipped with a lubrication device based on the oil pan apparatus.

Further, in addition to the thermostat valve apparatus 34, which has been described in conjunction with the foregoing concrete examples, a solenoid valve apparatus, a hydraulically-operated valve apparatus, a pneumatic valve apparatus, or other similar apparatuses may be used as the valve mechanism to be applied to the present invention. Valve open/close control may be exercised in accordance with the operating time or a cooling water temperature instead of the (first chamber) oil temperature, which is used in the foregoing concrete examples. As the valve mechanism to be applied to the present invention, it is possible to use a so-called open/close valve (which opens/closes upon power on/off) in addition to a flow control valve whose opening is variable.

The structure for fastening the oil pan separator and oil pan cover to the cylinder block is not limited to the use of the aforementioned bolts for simultaneous fastening. Various other fastening structures (e.g., a chuck-based fastening structure) may be used alternatively.

In the foregoing embodiments, the oil pan cover, which is substantially shaped like a bathtub, and the oil pan separator are stacked so that the second chamber is formed beneath the first chamber. However, the present invention is not limited to the use of such a configuration. For example, the oil pan separator may alternatively comprise a partition wall that extends vertically to divide the internal space of the oil pan cover in a horizontal direction.

Another alternative is to check, before the occurrence of a failure, for abnormalities, such as a degraded operation characteristic of the thermostat valve apparatus 34 (e.g., delayed follow-up of the valve opening ratio in relation to temperature changes). In other words, an abnormality may be located to issue a warning before an actual failure occurs.

Figure 6:
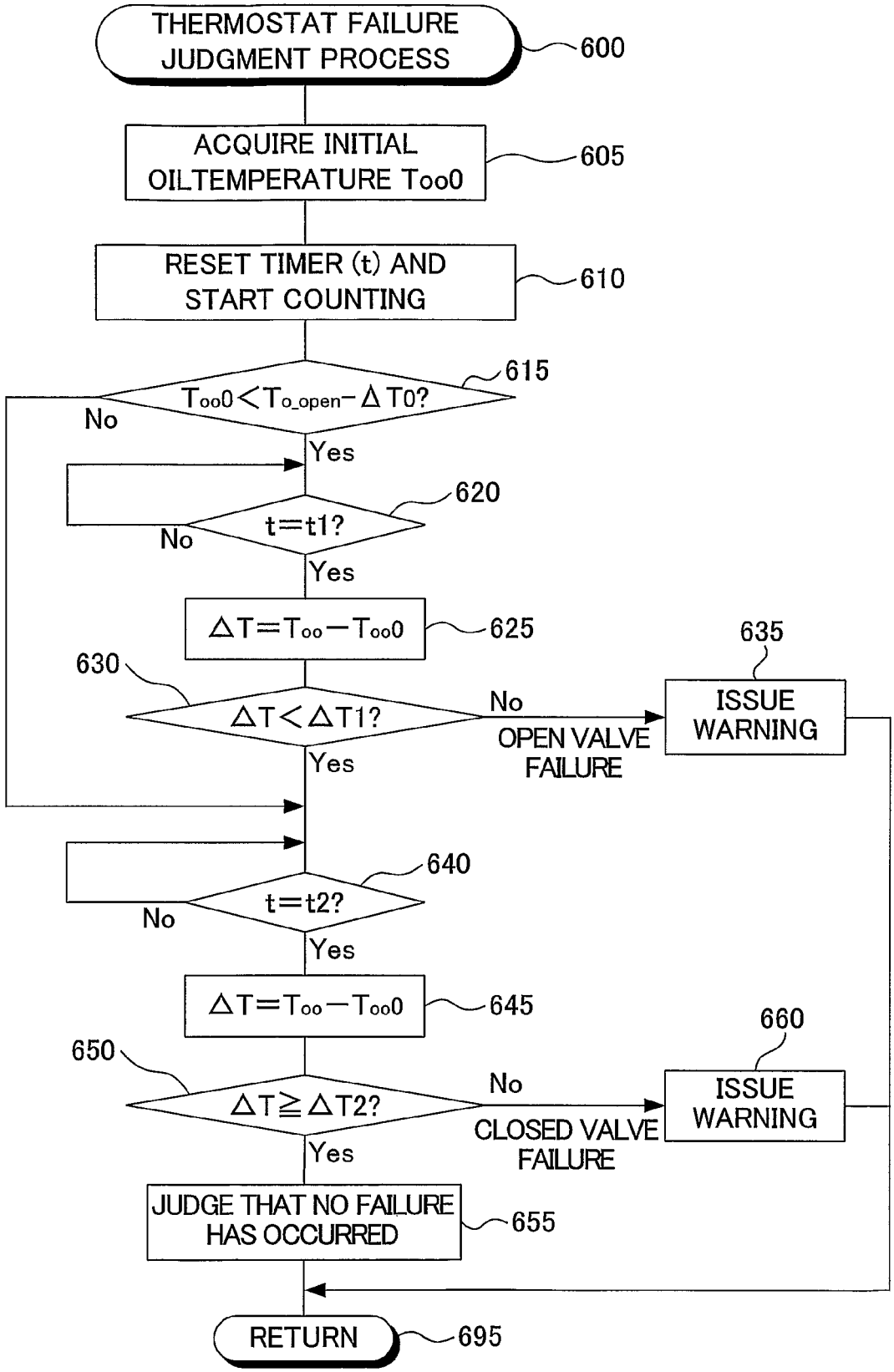
FIG. 6 is a flowchart illustrating an example of a thermostat valve apparatus abnormality judgment process that is performed by the control system shown in FIG. 4.

Further, if the judgment result obtained in step 615 of the flowchart shown in FIG. 6 indicates that the initial oil temperature Too0 is not lower than the valve opening temperature To_open of the thermostat valve apparatus 34 (the engine is hot started) (if the query in step 615 is answered "No"), an alternative is to refrain from formulating a failure judgment and proceed to step 695. Similarly, if the judgment result obtained in step 810 of the flowchart shown in FIG. 8 indicates that the initial water temperature Tw0 is not lower than the predetermined temperature (the engine is hot started) (if the query in step 810 is answered "No"), an alternative is to perform a closed valve failure judgment process.

The invention claimed is:

1. An oil pan apparatus having an oil pan cover, which has an internal space for storing lubricating oil for a lubrication target mechanism, and an oil pan separator, which is positioned in the internal space so as to form a first chamber and a second chamber within the internal space, the second chamber being adjacent to the first chamber, wherein the oil pan separator includes an oil communication path for permitting the interchange of oil between the first chamber and the second chamber, and wherein the oil communication path includes a valve mechanism for controlling the interchange of oil in the oil communication path between the first chamber and the second chamber in accordance with the operation of the lubrication target mechanism, the oil pan apparatus comprising:

an oil temperature sensor configured to output a signal in accordance with the oil temperature in the first chamber and/or the second chamber;

a judgment section configured so as to judge from an output generated by the oil temperature sensor whether any abnormality exists in the valve mechanism, the judgment section comprising:

an interface connected between the oil temperature sensor and a warning lamp; and a CPU connected to the interface and configured to illuminate the warning lamp based on a maximum rate of oil temperature rise from an initial temperature of the second chamber after an elapsed predetermined time from engine startup or a minimum rate of oil temperature rise from the initial temperature of the second chamber, before the elapsed predetermined time from engine startup.

2. An oil pan apparatus having an oil pan cover, which has an internal space for storing lubricating oil for a lubrication target mechanism, and an oil pan separator, which is positioned in the internal space, wherein the oil pan separator is positioned so that the internal space contains a first chamber with which an oil strainer is located at a bottom and a second chamber, the first chamber being open toward the lubrication target mechanism, the oil strainer constituting an oil intake port connected to an oil pump for supplying oil to the lubrication target mechanism, and the second chamber being adjacent to the first chamber; wherein the oil pan separator is provided with an oil communication path for permitting the interchange of oil between the first chamber and the second chamber; and wherein the oil communication path includes a valve mechanism for controlling the interchange of oil in the oil communication path between the first chamber and the second chamber in accordance with the operation of the lubrication target mechanism, the oil pan apparatus comprising:

an oil temperature sensor configured to output a signal in accordance with the oil temperature in the first chamber and/or the second chamber;

a judgment section configured so as to judge from an output generated by the oil temperature sensor whether any abnormality exists in the valve mechanism, the judgment section comprising:

an interface connected between the oil temperature sensor and a warning lamp; and a CPU connected to the interface and configured to illuminate the warning lamp based on a maximum rate of oil temperature rise from an initial temperature of the second chamber after an elapsed predetermined time from engine startup or a minimum rate of oil temperature rise from the initial temperature of the second chamber, before the elapsed predetermined time from engine startup.

3. An oil pan apparatus having an oil pan cover, which has an internal space for storing lubricating oil for a lubrication target mechanism, and an oil pan separator, which is positioned in the internal space, wherein the oil pan separator is positioned so that the internal space contains a first chamber with which an oil strainer is located at a bottom and a second chamber, the first chamber being open toward the lubrication target mechanism, the oil strainer constituting an oil intake port connected to an oil pump for supplying oil to the lubrication target mechanism, and the second chamber being adjacent to the first chamber; wherein the oil pan separator is provided with an oil communication path for permitting the interchange of oil between the first chamber and the second chamber; and wherein the oil communication path includes a valve mechanism for controlling the interchange of oil in the oil communication path between the first chamber and the second chamber in accordance with the operation of the lubrication target mechanism, the oil pan apparatus comprising:

an oil temperature sensor that is positioned in the second chamber to output a signal in accordance with the oil temperature in the second chamber;

a judgment section configured so as to judge from an output generated by the oil temperature sensor whether any abnormality exists in the valve mechanism, the judgment section further comprises:

an interface connected between the oil temperature sensor and a warning lamp; and a CPU connected to the interface and configured to illuminate the warning lamp based on a maximum rate of oil temperature rise from an initial temperature of the second chamber after an elapsed predetermined time from engine startup or a minimum rate of oil temperature rise from the initial temperature of the second chamber, before the elapsed predetermined time from engine startup.

4. The oil pan apparatus according to claim 3, wherein the oil pan separator has a concave section that is open toward the lubrication target mechanism and forms the first chamber;

wherein a gap for forming a space that constitutes the second chamber is provided between a bottom plate of the oil pan separator and a bottom plate of the oil pan cover, which forms the bottom surface of the second chamber;

wherein a side plate of the oil pan separator for constituting the concave section together with the bottom plate of the oil pan separator is located above and connected to the bottom plate of the oil pan separator;

wherein a side plate of the oil pan cover that encloses the side plate of the oil pan separator is located above and connected to the bottom plate of the oil pan cover;

wherein a gap for forming a space that constitutes the second chamber is provided between the side plate of the oil pan separator and the side plate of the oil pan cover; and wherein the oil temperature sensor is mounted on the side plate or the bottom plate of the oil pan cover.

5. The oil pan apparatus according to claim 1, wherein the valve mechanism includes a thermosensitive transformation section, which is configured so as to vary in shape in accordance with the oil temperature.

6. The oil pan apparatus according to claim 1, wherein the judgment section is configured so as to check an abnormality of the valve mechanism by examining an output signal generated by the oil temperature sensor and an output signal generated by a water temperature sensor that is provided in the lubrication target mechanism to output a signal in accordance with the temperature of cooling water for cooling the lubrication target mechanism.

* * * * *